US007014430B2

(12) United States Patent
Seo

(10) Patent No.: US 7,014,430 B2
(45) Date of Patent: Mar. 21, 2006

(54) CYLINDER ASSEMBLY FOR COMPRESSORS, COMPRESSOR WITH THE CYLINDER ASSEMBLY, AND APPARATUS HAVING REFRIGERANT CIRCULATION CIRCUIT INCLUDING THE COMPRESSOR

(75) Inventor: Seung Don Seo, Suwon (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 398 days.

(21) Appl. No.: 10/430,373

(22) Filed: May 6, 2003

(65) Prior Publication Data

US 2004/0175280 A1 Sep. 9, 2004

(30) Foreign Application Priority Data

Mar. 5, 2003 (KR) ..... 10-2003-0013806

(51) Int. Cl.
*F04B 39/00* (2006.01)
*F01N 7/00* (2006.01)

(52) U.S. Cl. ..... 417/312; 181/403

(58) Field of Classification Search ..... 417/312; 181/251, 403

See application file for complete search history.

(56) References Cited

U.S. PATENT DOCUMENTS 4,573,881 A * 3/1986 Romer ..... 417/312
5,173,034 A * 12/1992 Riffe ..... 181/403
6,152,703 A * 11/2000 Yoshimura et al. ..... 181/403
6,835,050 B1 * 12/2004 Na et al. ..... 417/312

FOREIGN PATENT DOCUMENTS

KR 2002-0062105 7/2002
KR 2002-0071667 9/2002

OTHER PUBLICATIONS

Korean Patent Abstract (KR) of 2002-0071667dated Sep. 13, 2002.
Korean Patent Abstract (KR) of 2002-0062105 dated Jul. 25, 2002.

* cited by examiner

*Primary Examiner*—Michael Koczo, Jr.
(74) *Attorney, Agent, or Firm*—Ladas & Parry LLP

(57) ABSTRACT

Disclosed herein are a cylinder assembly for compressors, a compressor with the cylinder assembly, and an apparatus having a refrigerant circulation circuit with the compressor. The present invention provides the cylinder assembly, which has a simple structure and is designed to further reduce a pulse noise. The cylinder assembly includes a cylinder block having two exhaust mufflers. Each of the exhaust mufflers is opened at an end thereof. A frame is mounted to the cylinder block to cover the open ends of the exhaust mufflers. At least one channel is formed at a junction between the cylinder block and the frame to allow a refrigerant to flow between the exhaust mufflers. Further, the cylinder assembly of the present invention is applied to a compressor, and the compressor of the present invention is applied to an apparatus having a refrigerant circulation circuit. The present invention allows a refrigerant exhaust pulse to be further reduced, and simplifies a construction of the cylinder assembly, thus increasing the assembling efficiency and the productivity of the compressor having the cylinder assembly, and reducing the manufacturing cost of the compressor, and reducing a size of the compressor.

20 Claims, 12 Drawing Sheets

CYLINDER ASSEMBLY FOR COMPRESSORS, COMPRESSOR WITH THE CYLINDER ASSEMBLY, AND APPARATUS HAVING REFRIGERANT CIRCULATION CIRCUIT INCLUDING THE COMPRESSOR

CROSS-REFERENCE TO RELATED APPLICATION

This application claims the benefit of Korean Application No. 2003-13806, filed Mar. 5, 2003, in the Korean Intellectual Property Office, the disclosure of which is incorporated herein by reference.

BACKGROUND OF THE INVENTION

1. Field of the Invention

The present invention relates, in general, to a cylinder assembly for compressors, a compressor with the cylinder assembly, and an apparatus having a refrigerant circulation circuit including the compressor and, more particularly, to a cylinder assembly having two exhaust mufflers to reduce an exhaust pulse, a compressor with the cylinder assembly, and an apparatus having a refrigerant circulation circuit including the compressor.

2. Description of the Related Art

Generally, a compressor is applied to a refrigerant circulation circuit, and the refrigerant circulation circuit is applied to an apparatus for cooling or heating air inside an enclosed space by performing a heat exchange process, such as heater-cooler systems and refrigerators.

The compressor includes a compressing unit, a motor unit, and a casing. The compressing unit compresses a refrigerant using a power transmitted from the motor unit. The compressing unit and the motor unit are hermetically sealed in the casing.

However, when the compressed refrigerant is discharged from the compressing unit, vibration and noise are generated due to an exhaust pulse caused by the intermittent exhaust of the refrigerant. Thus, there have been made many attempts to reduce the exhaust pulse.

For example, there have been proposed Korean Patent Laid-Open Publication No. 2002-0071667 and Korean Patent Laid-Open Publication No. 2002-0062105, which are invented by the same inventor as the present invention. According to the above patents, a cylinder assembly includes a cylinder block which has a compression chamber and two exhaust mufflers. Each of the exhaust mufflers is opened at an end thereof. Two muffler covers cover the exhaust mufflers. A connection pipe connects the muffler covers to each other. A cylinder head is provided at a front surface of the cylinder block to seal the compression chamber, and is partitioned into a refrigerant intake chamber and a refrigerant discharge chamber. The cylinder assembly also has a valve unit, which is described as a valve assembly in the above-mentioned patents. The valve unit is provided between the front surface of the cylinder block and the cylinder head, and includes a discharge valve plate and an intake valve plate to control the discharge and intake of a refrigerant which passes the compression chamber. Such a cylinder assembly reduces of the exhaust pulse to some extent. But, the inventor has continuously made efforts to further reduce the exhaust pulse and simplify the structure of the cylinder assembly, and so developed a cylinder assembly which will be described in the following.

SUMMARY OF THE INVENTION

Accordingly, it is an aspect of the present invention to provide a cylinder assembly, which is designed to further reduce an exhaust pulse in comparison with conventional cylinder assemblies, has a simple structure, and is applicable to a small-sized compressor, and to provide a compressor with the cylinder assembly and an apparatus having a refrigerant circulation circuit with the compressor.

Additional aspects and advantages of the invention will be set forth in part in the description which follows and, in part, will be obvious from the description, or may be learned by practice of the invention.

The foregoing and other aspects of the present invention are achieved by providing a cylinder assembly for compressors, including a cylinder block having a compression chamber and first and second exhaust mufflers, each of the exhaust mufflers being opened at an end thereof, a frame mounted to the cylinder block to cover the open ends of the discharge mufflers, and at least one channel formed at a junction between the cylinder block and the frame to allow a refrigerant to flow between the exhaust mufflers.

The channel may be formed on the cylinder block.

The channel may be formed on the frame.

A gasket is provided at the junction between the cylinder block and the frame to seal the junction, and the channel is formed on the gasket.

Each of the first and second discharge mufflers has a volume of 15 cc to 25 cc.

The channel is designed such that a length thereof is longer than a distance between the first and second discharge mufflers.

The channel is formed such that a sectional area of an end thereof adjacent to the first exhaust muffler is larger than a sectional area of an end thereof adjacent to the second exhaust muffler.

Further, the foregoing and other aspects of the present invention are achieved by providing a cylinder assembly for compressors, including a cylinder block having two exhaust mufflers, each of the discharge mufflers being opened at an end thereof, a frame mounted to the cylinder block to cover the open ends of the exhaust mufflers, and a plurality of channels formed at a junction between the cylinder block and the frame to allow a refrigerant to flow between the exhaust mufflers.

At least one of the channels has a sectional area which is different from a sectional area of the other channels.

A gasket is provided at the junction between the cylinder block and the frame to seal the junction, and the channels are formed on the gasket.

Further, the foregoing and other aspects of the present invention are achieved by providing a cylinder assembly for compressors, including a cylinder block having two exhaust mufflers, each of the exhaust mufflers being opened at an end thereof, a frame mounted to the cylinder block to cover the open ends of the exhaust mufflers, and first and second channels formed at a junction between the cylinder block and the frame to allow a refrigerant to flow between the exhaust mufflers.

The first and second channels have different sectional areas. In this case, the sectional area of the first channel is 2.5 $mm^2$ to 10.0 $mm^2$, while the sectional area of the second channel is 1.2 $mm^2$ to 5.0 $mm^2$.

A gasket is provided at the junction between the cylinder block and the frame to seal the junction, and the first and second channels are formed on the gasket.

Further, the foregoing and other aspects of the present invention are achieved by providing a cylinder assembly, including a cylinder block having a compression chamber and two exhaust mufflers, each of the exhaust mufflers being opened at a bottom end thereof, a frame mounted to the cylinder block to cover the open bottom ends of the exhaust mufflers, a passage to allow a refrigerant to flow between the exhaust mufflers, and at least one oil collecting groove provided at a predetermined portion of the frame to collect oil from the discharge mufflers.

The oil collecting groove has a volume of 2 cc to 8 cc.

The passage comprises a channel formed at a junction between the cylinder block and the frame. A gasket is provided at the junction between the cylinder block and the frame to seal the junction, and the channel is formed on the gasket.

Further, the foregoing and other aspects of the present invention are achieved by providing a compressor having the cylinder assembly according to the present invention.

Furthermore, the foregoing and other aspects of the present invention are achieved by providing an apparatus with a refrigerant circulation circuit having the compressor according to the present invention.

BRIEF DESCRIPTION OF THE DRAWINGS

These and other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
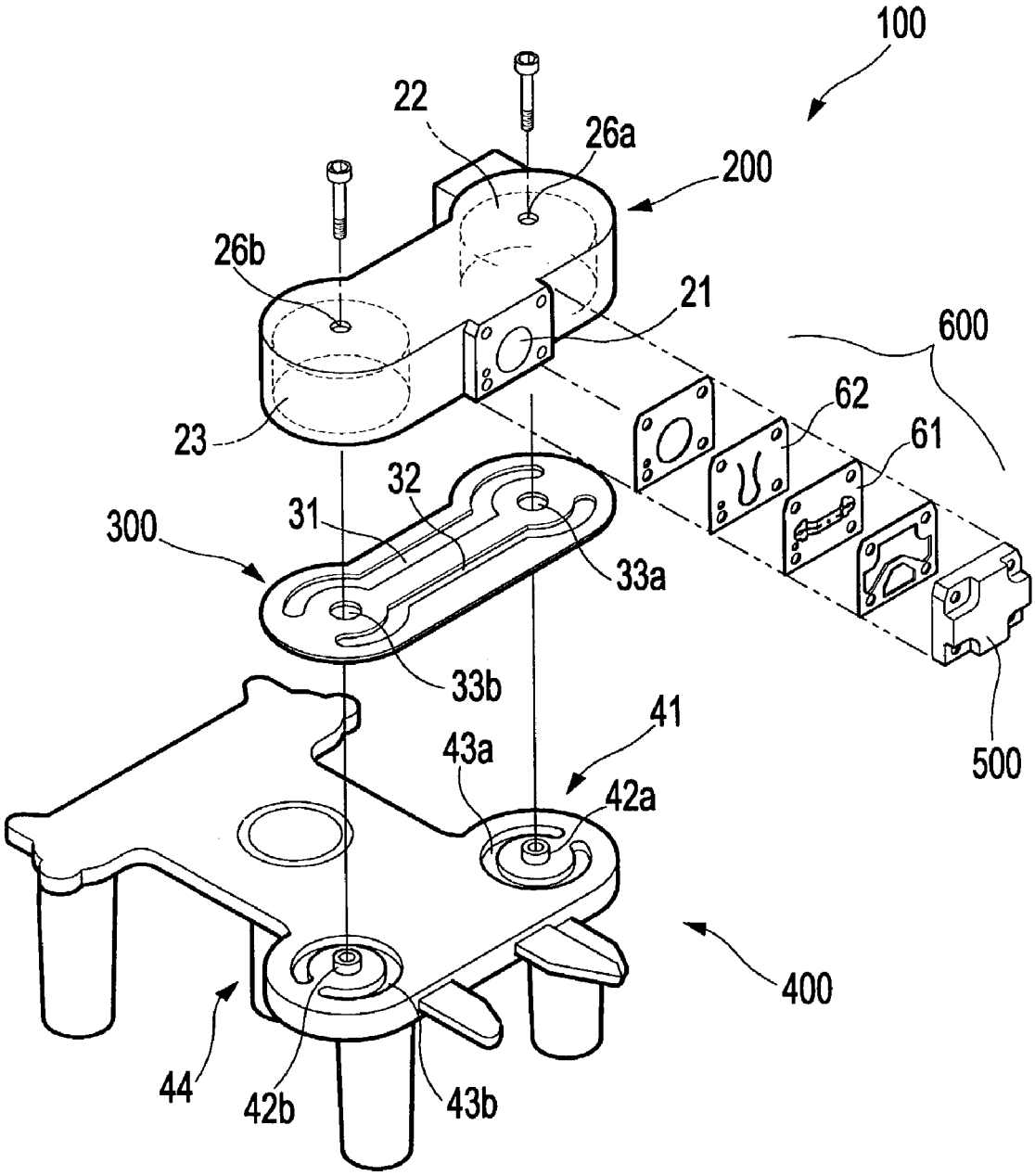
FIG. 1 is an exploded perspective view a cylinder assembly, according to a first embodiment of the present invention.

Reference will now be made in detail to the present preferred embodiments of the present invention, examples of which are illustrated in the accompanying drawings, wherein like reference numerals refer to like elements throughout.

Figure 2:
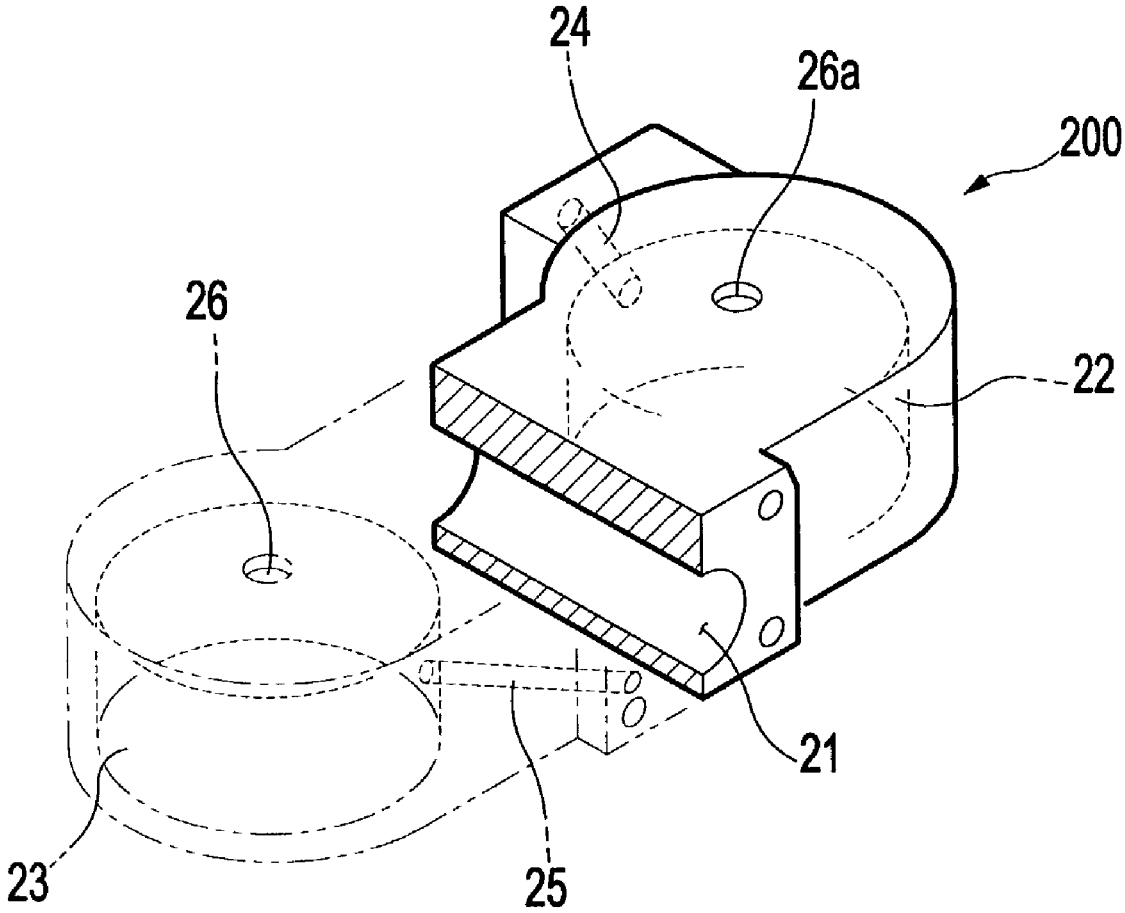
FIG. 2 is a broken perspective view of a cylinder block included in the cylinder assembly of FIG. 1.
Figure 3A:
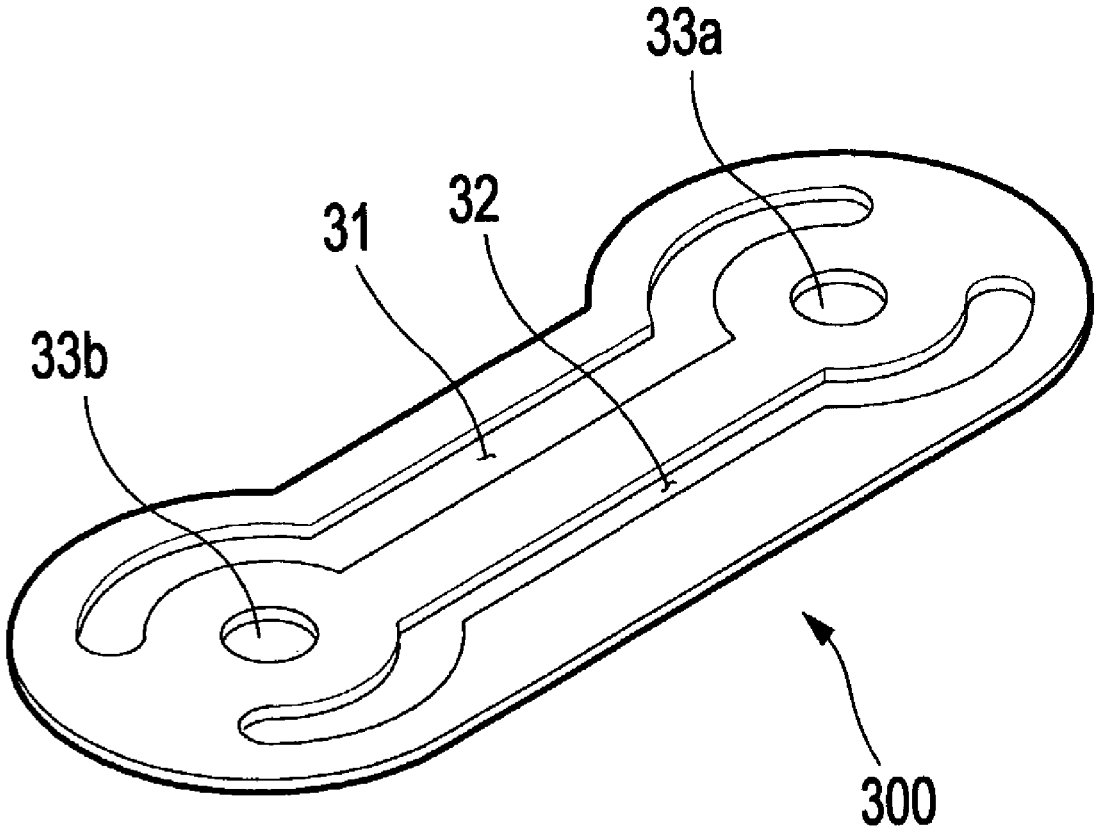
FIG. 3A is a perspective view of a gasket included in the cylinder assembly of FIG. 1.
Figure 3B:
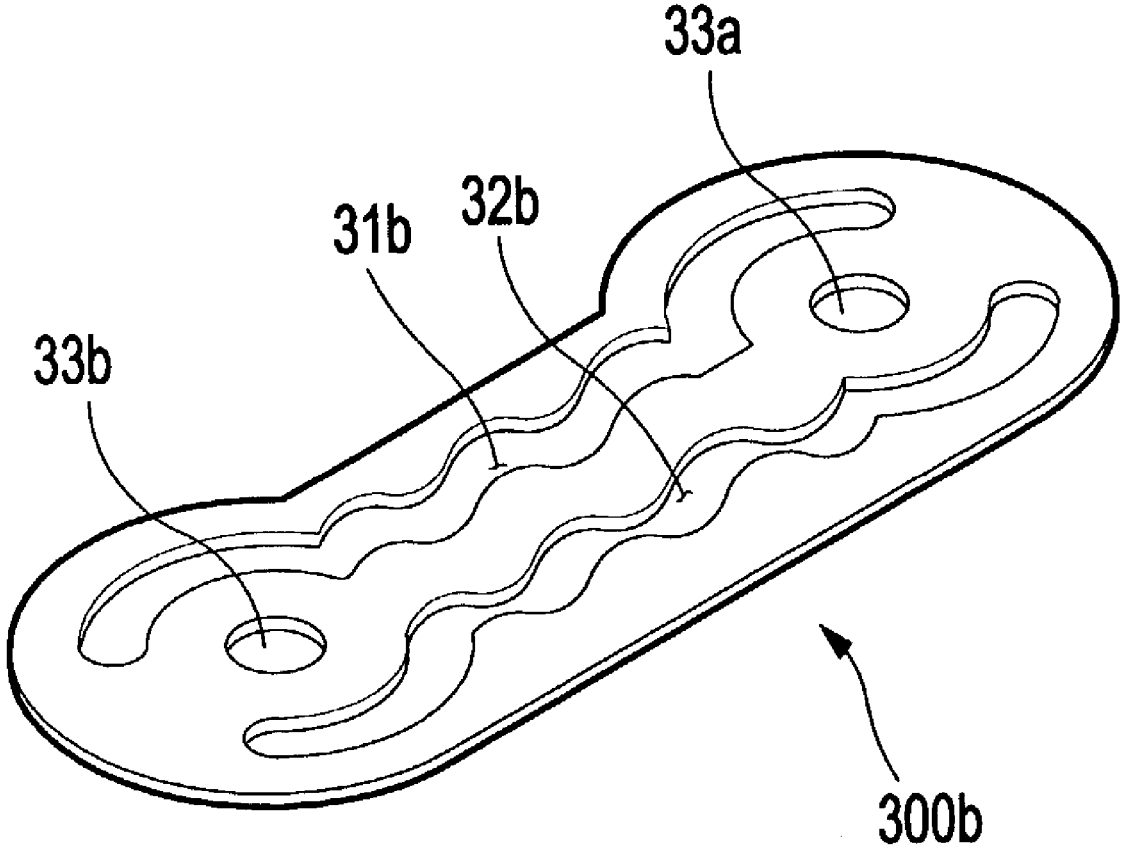
FIGS. 3B to 3D are perspective views of gaskets, according to three modifications of the first embodiment.
Figure 3C:
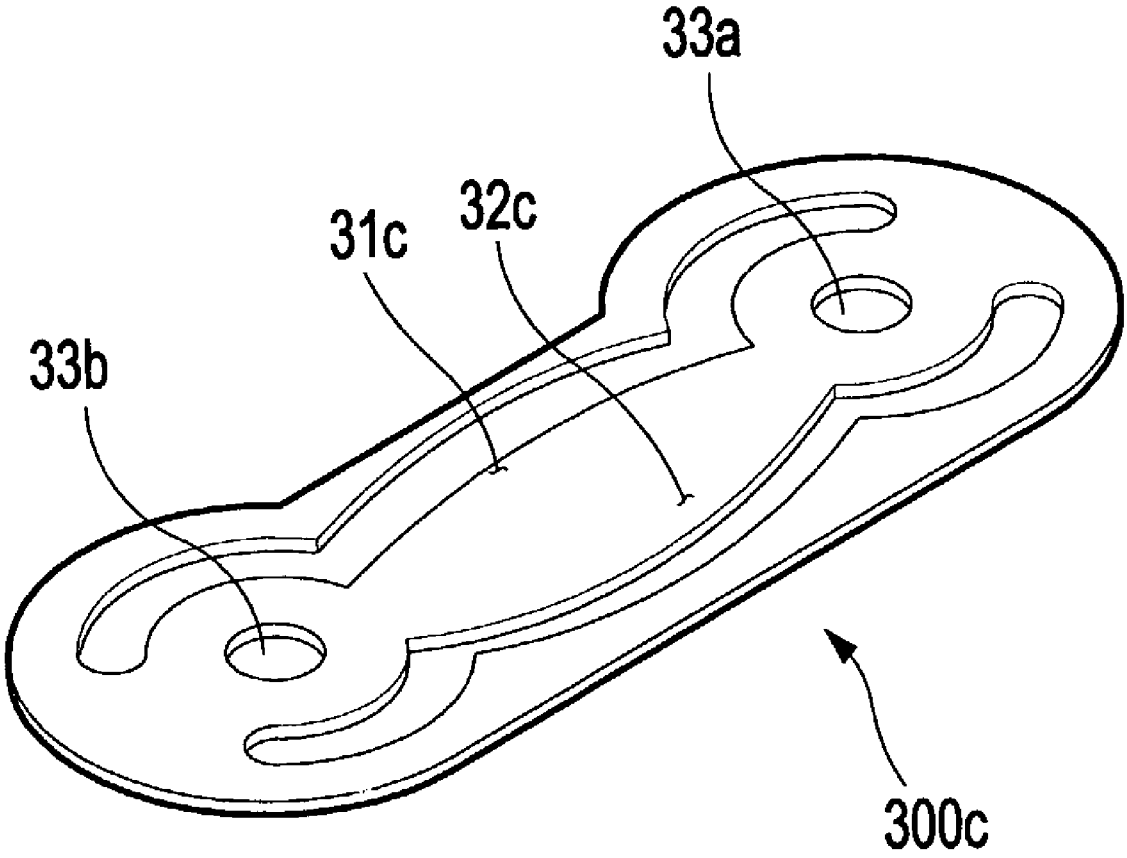
Figure 3D:
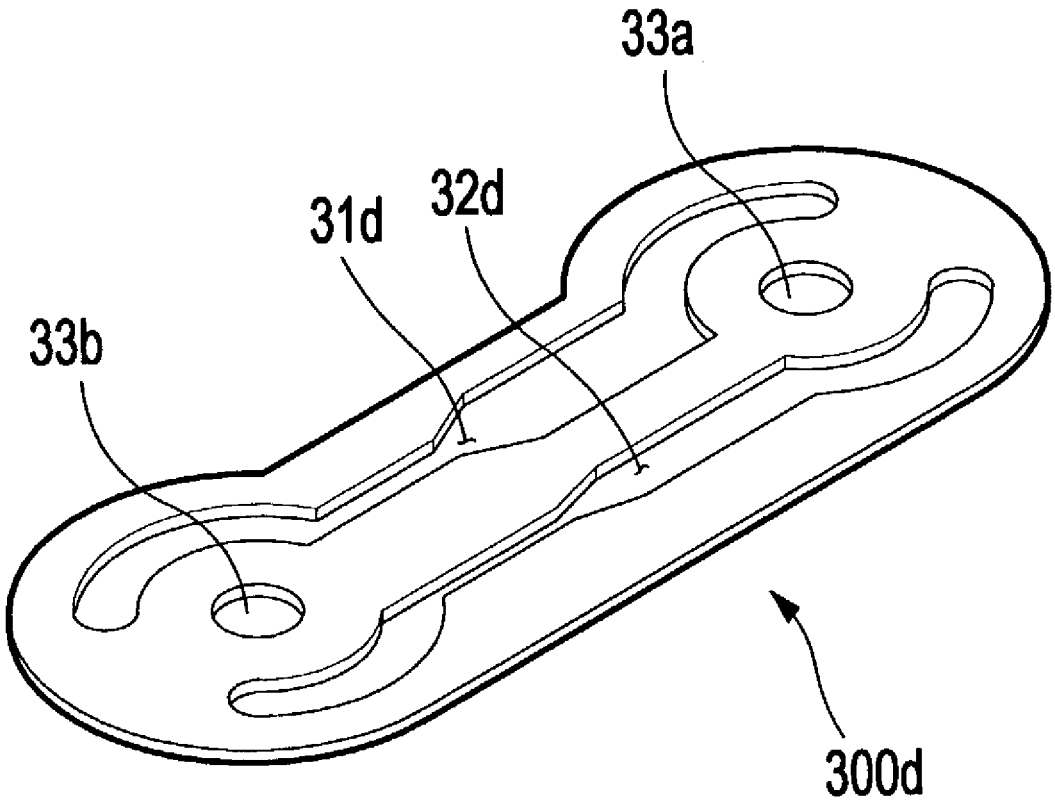
Figure 4:
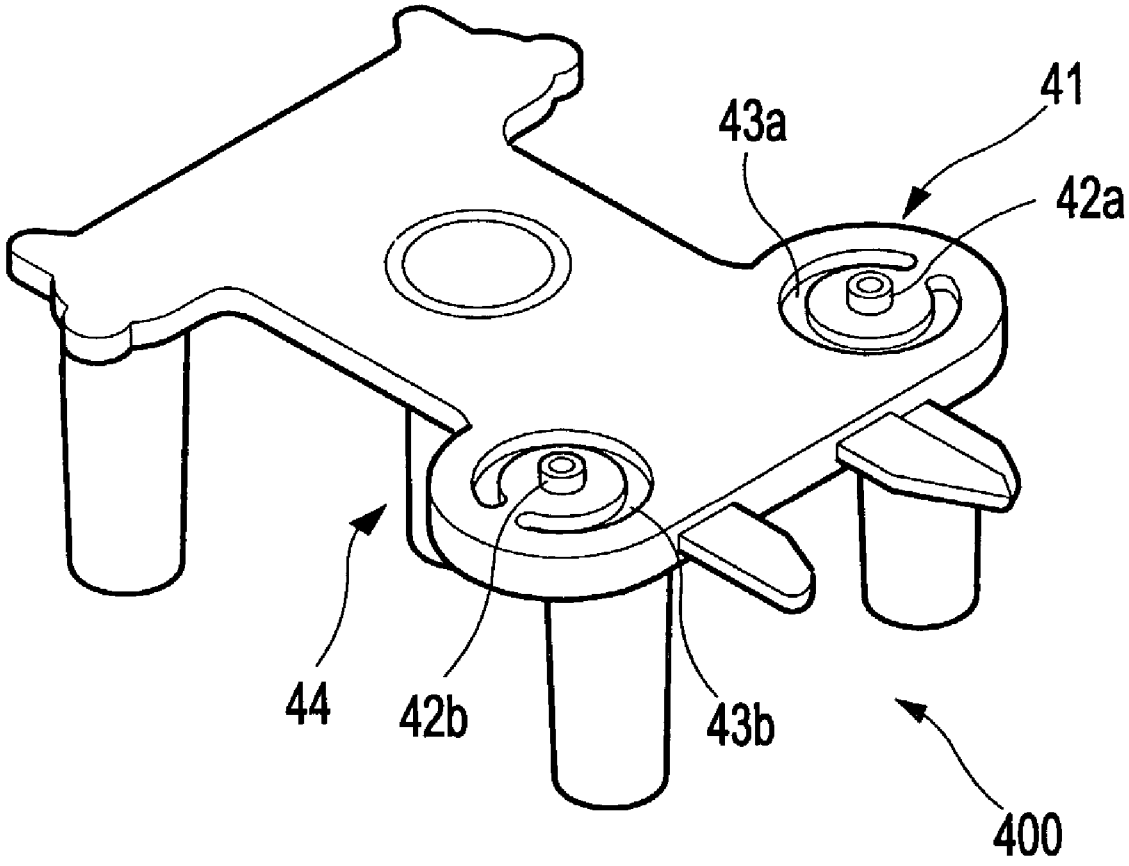
FIG. 4 is a perspective view of a frame included in the cylinder assembly of FIG. 1.

FIG. 1 is an exploded perspective view of a cylinder assembly 100, according to a first embodiment of the present invention. FIG. 2 is a perspective view of a cylinder block 200 included in the cylinder assembly 100 of FIG. 1. FIG. 3A is a perspective view of a gasket 300 included in the cylinder assembly of FIG. 1. FIGS. 3B to 3D are perspective views of gaskets 300*b*, 300*c*, and 300*d*, according to three modifications of the first embodiment. FIG. 4 is a perspective view of a frame 400 included in the cylinder assembly 100 of FIG. 1.

Referring to FIG. 1, the cylinder assembly 100 according to the first embodiment of the present invention includes a cylinder block 200. The cylinder block 200 has a compression chamber 21 and first and second exhaust mufflers 22 and 23. The first and second exhaust mufflers 22 and 23 are provided at both sides of the compression chamber 21, and are opened at bottom ends thereof. A frame 400 is mounted to the cylinder block 200 to cover the open bottom ends of the first and second exhaust mufflers 22 and 23. A gasket 300 is provided at a junction between the cylinder block 200 and the frame 400 to seal the junction. A cylinder head 500 is provided at a front surface of the cylinder block 200 to seal the compression chamber 21, and is partitioned into a refrigerant intake chamber and a refrigerant discharge chamber. The cylinder assembly 100 also includes a valve unit 600. The valve unit 600 is provided between the front surface of the cylinder block 200 and the cylinder head 500, and has a discharge valve plate 61 and an intake valve plate 62 to control the discharge and intake of a refrigerant which passes the compression chamber 21.

FIG. 2 illustrates a construction of the cylinder block 200 in detail. As illustrated in FIG. 2, a discharge hole 24 is formed at a predetermined portion of the first exhaust muffler 22 to discharge compressed air to the outside. A refrigerant passage 25 is provided at a portion outside the compression chamber 21 so that the refrigerant discharge chamber of the cylinder head 500 communicates with the second exhaust muffler 23 through the refrigerant passage 25.

The first and second exhaust mufflers 22 and 23 are provided with locking holes 26*a* and 26*b*, respectively, so as to mount the cylinder block 200 to the frame 400.

In this case, the larger volumes of the first and second exhaust mufflers 22 and 23 are, the more an exhaust pulse is reduced. However, it is preferable to design the first and second exhaust mufflers 22 and 23 such that each of the first and second exhaust mufflers 22 and 23 has a volume of 15 cc to 25 cc, considering a size of a compressor.

As illustrated in FIG. 3A, first and second channels 31 and 32 are formed on the gasket 300 to allow a refrigerant to flow between the first and second exhaust mufflers 22 and 23. Further, the gasket 300 is provided with locking holes 33*a* and 33*b* corresponding to the locking holes 26*a* and 26*b* of the cylinder block 200.

According to the first embodiment illustrated in FIGS. 1 and 3A, the first and second channels 31 and 32 each have a shape of a straight line. However, the first and second channels 31 and 32 may have different shapes, without being limited to the shape of the straight line. As a length of a channel formed between the first and second exhaust mufflers 22 and 23 is increased, the exhaust pulse is further reduced. So, it is preferable to increase a length of a passage defined between the first and second exhaust mufflers 22 and 23. Thus, it is necessary to design the first and second channels 31 and 32 such that the first and second channels 31 and 32 form a long passage. For example, as illustrated in FIG. 3B, first and second channels 31*b* and 32*b* may be formed on a gasket 300*b* so that the first and second channels 31*b* and 32*b* each have a wavy shape. Alternatively, as illustrated in FIG. 3C, first and second channels 31*c* and 32*c* may be formed on a gasket 300*c* so that the first and second channels 31*c* and 32*c* each have a curved shape.

Further, in order to further reduce the exhaust pulse, it is preferable to design the first and second channels 31 and 32 so that sectional areas of the first and second channels 31 and 32 along which the refrigerant flows are varied at a desired position. Such an example is illustrated in FIG. 3D. That is, as illustrated in FIG. 3D, first and second channels 31*d* and 32*d* are formed on a gasket 300*d* so that sectional areas of ends thereof adjacent to the first exhaust muffler 22 are larger than sectional areas of ends thereof adjacent to the second exhaust muffler 23.

Further, a single channel may be formed to define a passage between the first and second exhaust mufflers 22 and 23. Or, two or more channels may be formed between the first and second exhaust mufflers 22 and 23. However, a plurality of channels each having a small sectional area are more preferable than a single channel having a large sectional area, because, in case of having the plurality of channels, the refrigerant is distributed to the channels, so that an amount of the refrigerant flowing along each channel is reduced, and the exhaust pulse is reduced.

In case of forming a plurality of channels, it is preferable to design the channels such that the channels have different sectional areas, because pulse frequencies of the channels are different from each other according to a flow rate of the refrigerant flowing along each channel, so the pulse frequencies of the channels are offset. Thus, according to the present invention, the first and second channels 31, 31*b*, 31*c*, 31*d*/32, 32*b*, 32*c*, 32*d* are designed such that the sectional area of the first channel 31, 31*b*, 31*c*, 31*d* is different from the sectional area of the second channel 32, 32*b*, 32*c*, 32*d*. In this case, it is preferable that a sectional area of a channel is 2.5 $mm^2$ to 10.0 $mm^2$ while a sectional area of the other channel is 1.2 $mm^2$ to 5.0 $mm^2$, considering an area of the junction between the cylinder block 200 and the frame 400.

As illustrated in FIG. 4, the frame 400 includes a cover part 41, locking bosses 42*a* and 42*b*, first and second oil collecting grooves 43*a* and 43*b*, and a bearing part 44. The cover part 41 covers the open bottom ends of the first and second exhaust mufflers 22 and 23, the first channel 31, 31*b*, 31*c*, 31*d*, and the second channel 32, 32*b*, 32*c*, 32*d*. The locking bosses 42*a* and 42*b* are provided at the cover part 41 to correspond to the locking holes 26*a* and 26*b* of the cylinder block 200 and the locking holes 33*a* and 33*b* of the gasket 300, 300*b*, 300*c*, 300*d*. The first and second oil collecting grooves 43*a* and 43*b* are formed around the locking bosses 42*a* and 42*b*, respectively, to collect oil. A rotating shaft of the compressor is fitted into the bearing part 44.

Oil laden in the refrigerant passing the first exhaust muffler 22 is collected in the first oil collecting groove 43*a*, while oil laden in the refrigerant passing the second exhaust muffler 23 is collected in the second oil collecting groove 43*b*. Preferably, each of the first and second oil collecting grooves 43*a* and 43*b* has a volume of 2 cc to 8 cc, considering a size of the compressor.

According to the present invention, the refrigerant compressed in the compression chamber 21 sequentially passes through the compression chamber 21, the refrigerant discharge chamber of the cylinder head 500, the refrigerant passage 25, and the second exhaust muffler 23. While the refrigerant fed into the second exhaust muffler 23 flows into the first exhaust muffler 22 through the first channel 31, 31*b*, 31*c*, 31*d* and the second channel 32, 32*b*, 32*c*, 32*d*, a passage resistance applied to the refrigerant is increased, so the exhaust pulse is reduced. Further, a flow rate of the refrigerant flowing along the first channel 31, 31*b*, 31*c*, 31*d* is different from that of the refrigerant flowing along the second channel 32, 32*b*, 32*c*, 32*d*, so the exhaust pulse is further reduced due to the offset to the exhaust pulse.

After the refrigerant flows from the second exhaust muffler 23 through the first and second channels 31, 31*b*, 31*c*, 31*d*/32, 32*b*, 32*c*, 32*d* into the first exhaust muffler 22, the refrigerant is discharged from the compressor through the discharge hole 24 which is formed at the first exhaust muffler 22.

While the refrigerant passing through the refrigerant passage 25 strongly flows into the second exhaust muffler 23, the refrigerant collides against an inner surface of the second exhaust muffler 23. At this time, oil laden in the refrigerant flows down along the inner surface of the second exhaust muffler 23, so the oil is collected in the second oil collecting groove 43*b*. Further, while the refrigerant passing through the first and second channel 31, 31*b*, 31*c*, 31*d*/32, 32*b*, 32*c*, 32*d* strongly flows into the first exhaust muffler 22, the refrigerant collides against an inner surface of the first exhaust muffler 22. At this time, oil laden in the refrigerant flows down along the inner surface of the first exhaust muffler 22, so the oil is collected in the first oil collecting groove 43*a*. Through such an operation, an amount of the oil laden in the refrigerant is reduced.

Figure 5:
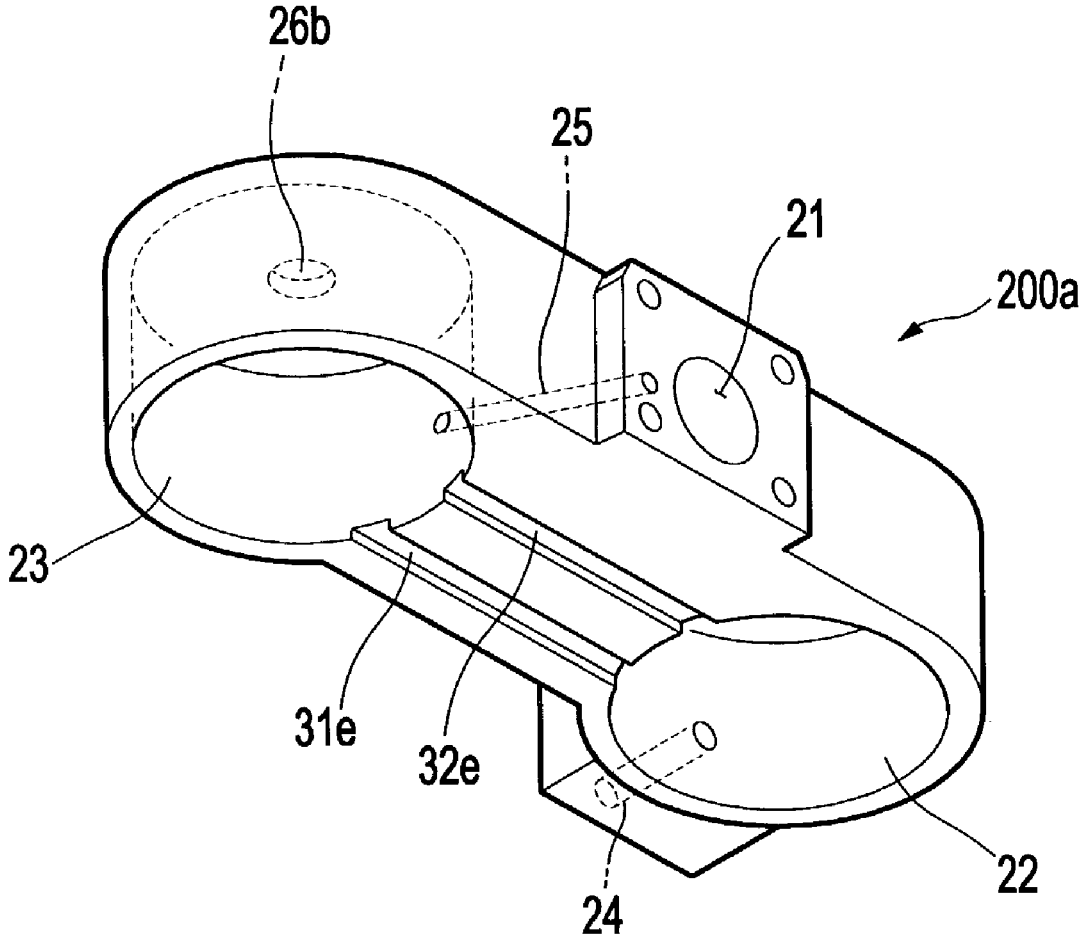
FIG. 5 is a bottom perspective view of a cylinder block, according to a second embodiment of the present invention.
Figure 6:
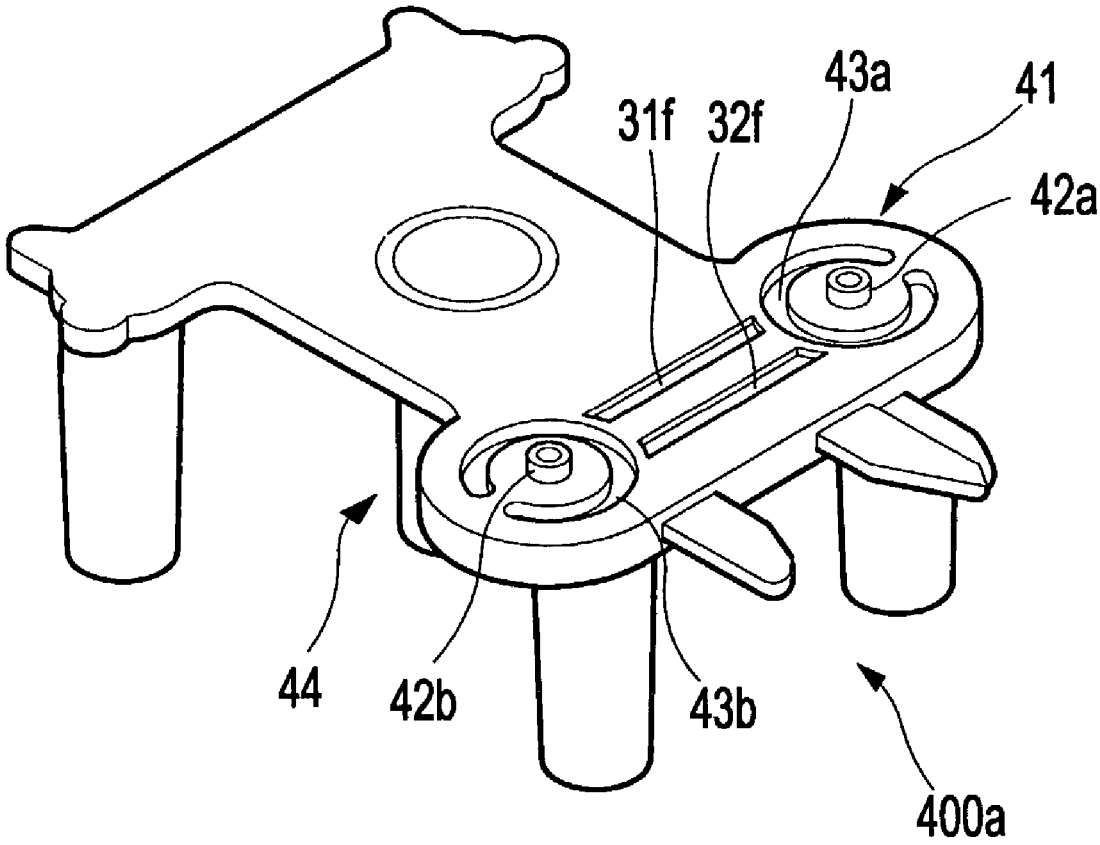
FIG. 6 is a perspective view of a frame, according to a third embodiment of the present invention.

According to the above-mentioned embodiment, the first and second channels 31, 31*b*, 31*c*, 31*d*/32, 32*b*, 32*c*, 32*d* are formed on the gasket 300 which is provided at the junction between the cylinder block 200 and the frame 400. However, as illustrated in FIG. 5, channels 31*e* and 32*e* may be formed on a cylinder block 200*a*. Alternatively, as illustrated in FIG. 6, channels 31*f* and 32*f* may be formed on a frame 400*a*.

Figure 7:
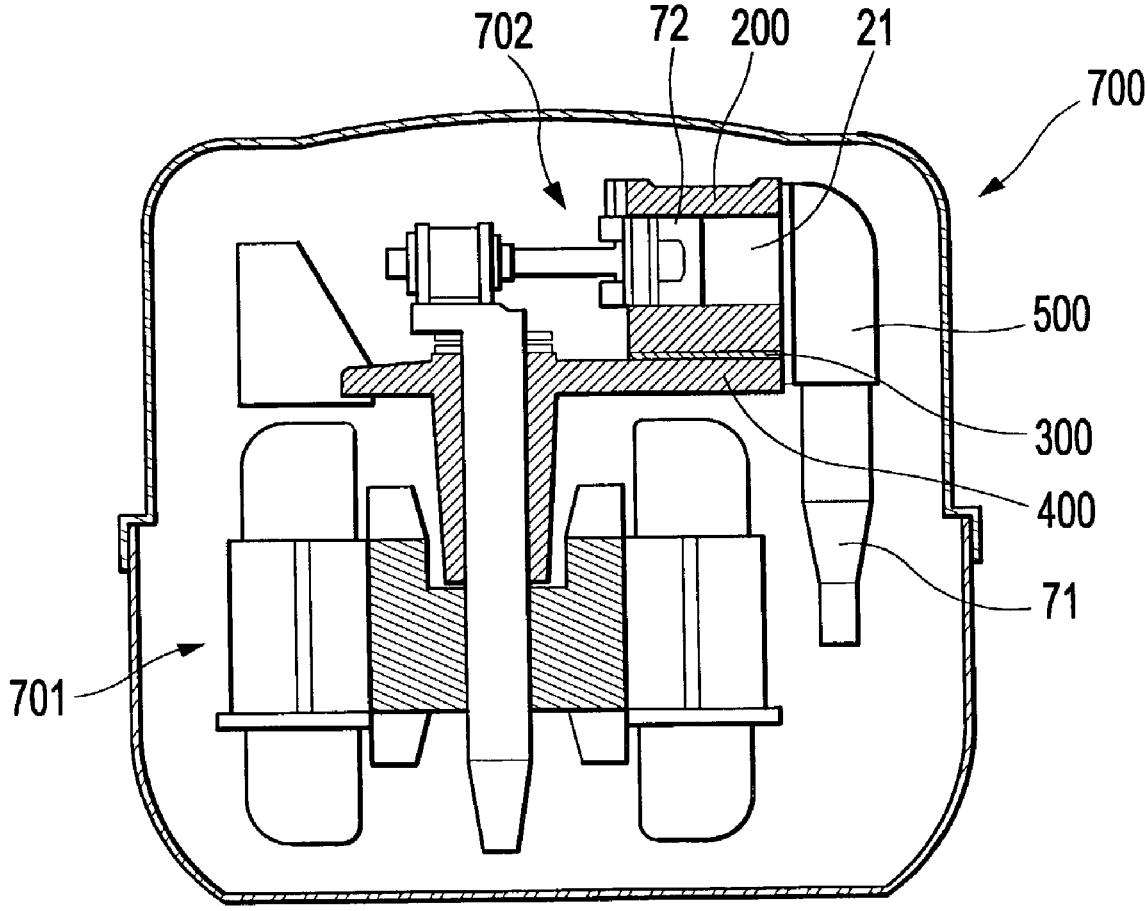
FIG. 7 is a sectional view of a compressor having the cylinder assembly of FIG. 1.

FIG. 7 illustrates a compressor 700 having the cylinder assembly of FIG. 1.

The compressor 700 is arranged between an evaporator 91 (see, FIG. 9) and a condenser 92 (see, FIG. 9) to compress a refrigerant evaporated in the evaporator 91, prior to being fed into the condenser 92. The refrigerant fed from the evaporator 91 passes through an intake pipe, an intake muffler 71, and the refrigerant intake chamber of the cylinder head 500 to the compression chamber 21, as illustrated in FIG. 7. The refrigerant fed into the compression chamber 21 is compressed by a piston 72, and then passes through the refrigerant discharge chamber of the cylinder head 500, the refrigerant passage 25, the second exhaust muffler 23, the first and second channels, the first exhaust muffler 22, and the discharge hole 24. As such, while the refrigerant passes through the refrigerant discharge chamber, the refrigerant passage 25, the second exhaust muffler 23, the first and second channels, the first exhaust muffler 22, and the discharge hole 24, the pulse is reduced. Thereafter, the refrigerant is fed into the condenser 92 through a discharge pipe (not shown) which is connected to the discharge hole 24.

According to the embodiment illustrated in FIG. 7, the compressor 700 is designed such that a motor unit 701 is provided at a lower portion of the compressor 700 and a compressing unit 702 is provided at an upper portion of the compressor 700. However, the motor unit 701 may be provided at the upper portion of the compressor 700 and the compressing unit 702 may be provided at the lower portion of the compressor 700, without departing from the principles and spirit of the invention. That is, it is possible to accomplish the effect of the present invention, regardless of the positions of the motor unit 701 and the compressing unit 702.

Figure 8:
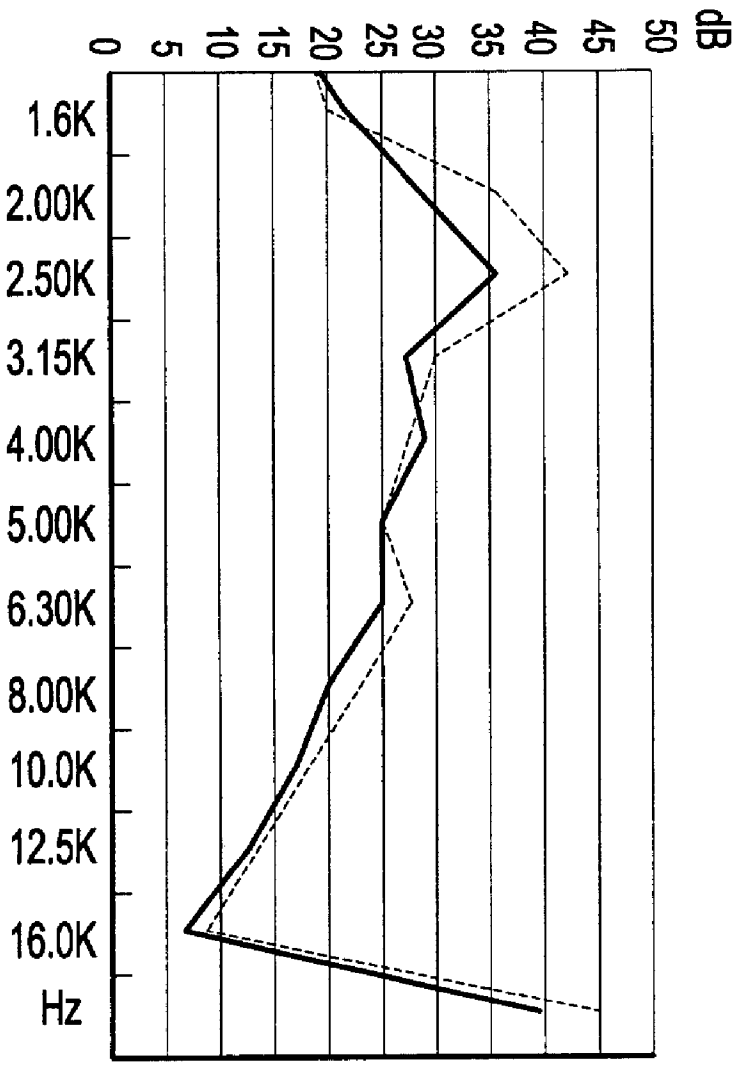
FIG. 8 is a graph illustrating a pulse noise of the compressor illustrated in FIG. 7.

FIG. 8 is a graph illustrating a pulse noise generated in a conventional compressor which is disclosed in Korean Patent Laid-Open Publication No. 2002-0062105, and a pulse noise generated in the compressor 700 of FIG. 7 having the cylinder assembly 100 of FIG. 1. A dotted line illustrates data obtained by the compressor which is disclosed in Korean Patent Laid-Open Publication No. 2002-0062105, whereas a solid line illustrates data obtained by the compressor 700 according to the present invention. In FIG. 8, the X-axis designates a frequency band (Hz) of an audio frequency, that is, 1.5 KHz to 20 KHZ, while the Y-axis designates a pulse noise (dB). As illustrated in FIG. 8, there is a considerable difference in the pulse noise between the conventional compressor and the compressor 700 of the present invention. That is, the compressor 700 of the present invention has a lower pulse noise in most of the frequency band, in comparison with the conventional compressor. Above all, the pulse noise of the compressor 700 according to the present invention is remarkably reduced in the frequency band between 1.6 KHz and 3.5 KHz, and between 5 KHz and 16 KHz.

Figure 9:
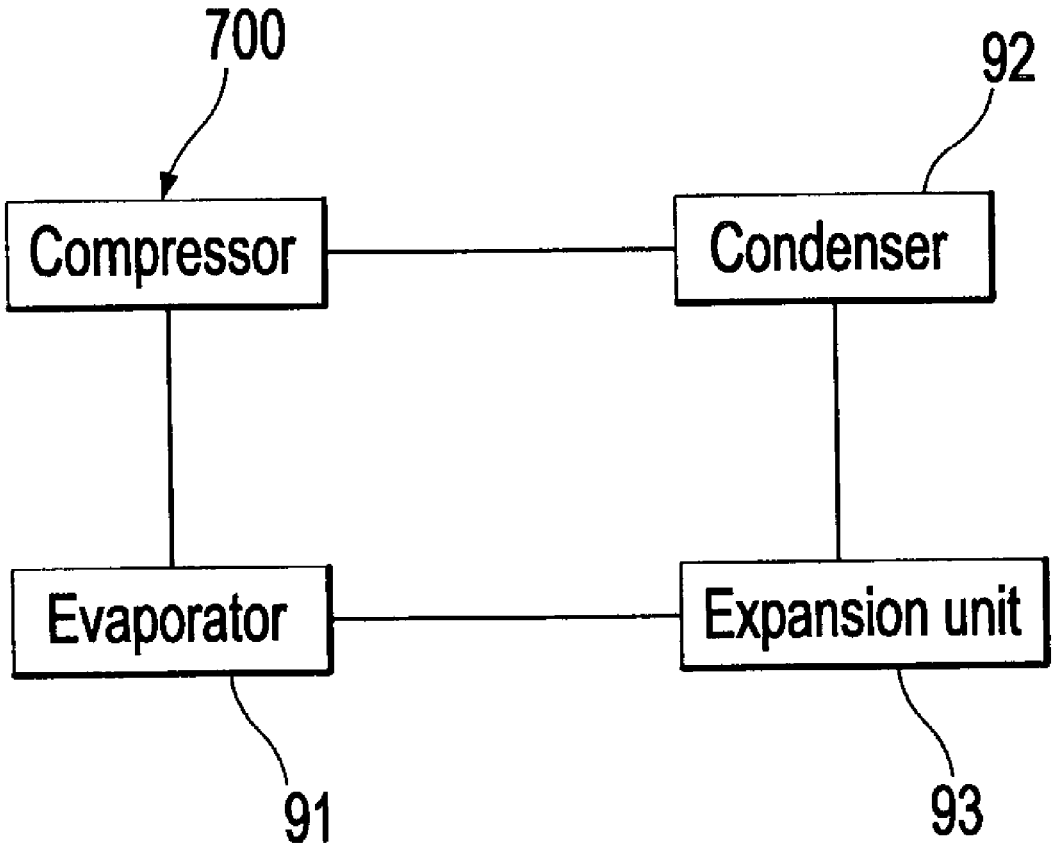
FIG. 9 is block diagram of a refrigerant circulation circuit having the compressor of FIG. 7.

FIG. 9 illustrates a refrigerant circulation circuit having the compressor of FIG. 7. The refrigerant circulation circuit has the same circulation construction as a general refrigerant circulation circuit. That is, a refrigerant is evaporated in the evaporator 91 to absorb heat from air around it, and then is fed into the compressor 700. The refrigerant compressed in the compressor 700 is fed into a condenser 92 to be condensed. Next, the refrigerant passes through an expansion unit 93, such as a capillary tube or an expansion valve, to be expanded, and then is returned to the evaporator 91.

Such a refrigerant circulation circuit is widely applied to an apparatus for heating or cooling air around the apparatus, such as heater-cooler systems and refrigerators.

As apparent from the above description, the present invention provides a cylinder assembly for compressors, which is designed to further reduce a refrigerant exhaust pulse and is not provided with a connection pipe connecting two mufflers to each other, different from Korea Patent Laid-Open Publication No.2002-0062105, thus allowing the structure of the cylinder assembly to be simple, therefore enhancing the assembling efficiency and the productivity of a compressor having the cylinder assembly, and reducing the manufacturing cost of the compressor, and dramatically reducing a size of the compressor.

Further, according to the present invention, oil laden in a refrigerant is collected, so an amount of oil laden in the refrigerant is reduced. Thus, a compression efficiency of the compressor is increased, so a cooling and heating efficiency of a refrigerant circulation circuit is increased.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cylinder assembly for compressors, comprising:

a cylinder block having two exhaust mufflers, each of the discharge mufflers being opened at an end thereof, a frame mounted to the cylinder block to cover the open ends of the exhaust mufflers; and a plurality of channels formed at a junction between the cylinder block and the frame to allow a refrigerant to flow between the exhaust mufflers.

2. The cylinder assembly according to claim 1, wherein at least one of the channels is formed on the cylinder block.

3. The cylinder assembly according to claim 1, wherein at least one of the channels is formed on the frame.

4. The cylinder assembly according to claim 1, wherein a gasket is provided at the junction between the cylinder block and the frame to seal the junction, and at least one of the channels is formed on the gasket.

5. The cylinder assembly according to claim 1, wherein each of the first and second discharge mufflers has a volume of 15 cc to 25 cc.

6. The cylinder assembly according to claim 1, wherein at least one of the channels is designed such that a length thereof is longer than a distance between the first and second discharge mufflers.

7. The cylinder assembly according to claim 1, wherein at least one of the channels is formed such that a sectional area of an end thereof adjacent to the first exhaust muffler is larger than a sectional area of an end thereof adjacent to the second exhaust muffler.

8. The cylinder assembly according to claim 1, wherein at least one of the channels has a sectional area which is different from a sectional area of the other channels.

9. The cylinder assembly according to claim 1, wherein a gasket is provided at the junction between the cylinder block and the frame to seal the junction, and the channels are formed on the gasket.

10. A compressor having the cylinder assembly according to claim 1.

11. An apparatus with a refrigerant circulation circuit having the compressor according to claim 10.

12. A cylinder assembly for compressors, comprising:

a cylinder block having two exhaust mufflers, each of the exhaust mufflers being opened at an end thereof;

a frame mounted to the cylinder block to cover the open ends of the exhaust mufflers; and first and second channels formed at a junction between the cylinder block and the frame to allow a refrigerant to flow between the exhaust mufflers.

13. The cylinder assembly according to claim 12, wherein the first and second channels have different sectional areas.

14. The cylinder assembly according to claim 13, wherein the sectional area of the first channel is 2.5 $mm^2$ to 10.0 $mm^2$.

15. The cylinder assembly according to claim 13, wherein the sectional area of the second channel is 1.2 $mm^2$ to 5.0 $mm^2$.

16. The cylinder assembly according to claim 12, wherein a gasket is provided at the junction between the cylinder block and the frame to seal the junction, and the first and second channels are formed on the gasket.

17. A cylinder assembly, comprising:

a cylinder block having a compression chamber and two exhaust mufflers, each of the exhaust mufflers being opened at a bottom end thereof;

a frame mounted to the cylinder block to cover the open bottom ends of the exhaust mufflers;

passages to allow a refrigerant to flow between the exhaust mufflers; and at least one oil collecting groove provided at a predetermined portion of the frame to collect oil from the discharge mufflers.

18. The cylinder assembly according to claim 17, wherein the oil collecting groove has a volume of 2 cc to 8 cc.

19. The cylinder assembly according to claim 17, wherein at least one of the passages comprises a channel formed at a junction between the cylinder block and the frame.

20. The cylinder assembly according to claim 19, wherein a gasket is provided at the junction between the cylinder block and the frame to seal the junction, and the channel is formed on the gasket.

* * * * *